US011930896B2

(12) United States Patent
Aoki

(10) Patent No.: US 11,930,896 B2
(45) Date of Patent: Mar. 19, 2024

(54) BAND AND WATCH

(71) Applicant: SEIKO EPSON CORPORATION, Tokyo (JP)

(72) Inventor: Takahiro Aoki, Shibuya (JP)

(73) Assignee: SEIKO EPSON CORPORATION (JP)

( * ) Notice: Subject to any disclaimer, the term of this patent is extended or adjusted under 35 U.S.C. 154(b) by 0 days.

(21) Appl. No.: 17/898,792

(22) Filed: Aug. 30, 2022

(65) Prior Publication Data

US 2023/0066719 A1 Mar. 2, 2023

(30) Foreign Application Priority Data

Aug. 31, 2021 (JP) ..... 2021-140981

(51) Int. Cl.
*A44C 5/14* (2006.01)
*A44C 5/02* (2006.01)

(52) U.S. Cl.
CPC . *A44C 5/14* (2013.01); *A44C 5/02* (2013.01)

(58) Field of Classification Search
CPC ..... A44C 5/02; A44C 5/14; G04B 37/1486
See application file for complete search history.

(56) References Cited

U.S. PATENT DOCUMENTS 4,217,681 A * 8/1980 Grohoski ..... A44C 5/14 224/164
4,564,308 A * 1/1986 Ikegami ..... A44C 5/14 968/360
6,014,793 A * 1/2000 Howald ..... A44C 5/147 24/265 B
6,163,942 A * 12/2000 Liao ..... A44B 11/266 24/593.1
6,647,593 B2 * 11/2003 Iguchi ..... G04B 37/1486 74/56
7,380,979 B2 * 6/2008 Hiranuma ..... A44C 5/14 368/282
7,507,018 B2 * 3/2009 Hozumi ..... A44C 5/14 368/282

(Continued)

FOREIGN PATENT DOCUMENTS

JP 2008-164428 A 7/2008
JP 2020-168218 A 10/2020

*Primary Examiner* — Robert Sandy
*Assistant Examiner* — Louis A Mercado
(74) *Attorney, Agent, or Firm* — Harness, Dickey & Pierce, P.L.C.

(57) ABSTRACT

A band includes first and second pin member including first and second pin, an operation member that moves between first and second positions, a housing including a coupling part and an engaging part, and a guide part that guides and moves the first and second pin members between an engagement position and a release position. The first and second pin members move to the engagement position when the operation member is moved to the first position, whereas move to the release position when the operation member is moved to the second position. The engagement/release position is a position where each pin is located outside/outside the side surface of the housing in the width direction, and the engagement/release position is closer to the coupling/engaging part than the release/engagement position in the longitudinal direction.

10 Claims, 12 Drawing Sheets

(56) References Cited

U.S. PATENT DOCUMENTS

| | | | | |
|---|---|---|---|---|
| 8,240,011 | B2 * | 8/2012 | Chevrolet | G04B 37/1493 24/265 B |
| 9,092,012 | B2 * | 7/2015 | Dornhege | G04B 37/1493 |
| 9,198,484 | B2 * | 12/2015 | Knuchel | A44C 5/08 |
| 2007/0070823 | A1 * | 3/2007 | Sima | A44C 5/14 368/282 |
| 2007/0271740 | A1 * | 11/2007 | Yamamoto | A44C 5/246 24/265 WS |
| 2008/0159085 | A1 | 7/2008 | Hozumi et al. | |
| 2014/0250637 | A1 * | 9/2014 | Stotz | G04B 37/1493 24/265 B |

* cited by examiner

BAND AND WATCH

The present application is based on, and claims priority from JP Application Serial Number 2021-140981, filed Aug. 31, 2021, the disclosure of which is hereby incorporated by reference herein in its entirety.

BACKGROUND

1. Technical Field

The present disclosure relates to a band and a watch.

2. Related Art

In wristwatches, spring bars are usually used to couple the wristwatch case and the band. In this case, the positions of the through hole formed in the end-piece of the band for insertion of the spring bar and the hole formed in the case for insertion of the both ends of the spring bar are intentionally shifted from each other, and, when inserting the both ends of the spring bar inserted in the through hole of the end-piece to the hole of the case, the end-piece is biased to the main body side by deflecting the spring bar so as to prevent formation of a gap between the case and the end-piece. Such installation of the spring bar is not easy for users because it requires special tools and techniques.

In view of this, JP-A-2020-168218 proposes a band coupling structure that is easy to attach/detach for the user. In JP-A-2020-168218, the watch case and the band are configured to be coupled by using a spring bar provided with a lever so that the user can easily attach/detach the band to/from the watch by sliding the lever.

In the band structure of JP-A-2020-168218, however, the spring bar and the case side hole should be located on one straight line because the spring bar is attached/detached to the case through the lever operation by sliding it in the width direction of the band. This results in backlash and gaps between the end-piece and the case due to variations of the components, and their high noticeability degrades the external appearance.

SUMMARY

A band of the present disclosure is configured to be attached to a watch case including a first engagement hole and a second engagement hole facing each other, the band including a band main body, and an end member provided at an end portion of the band main body. The end member includes a first pin member including a first pin configured to be engaged with the first engagement hole, a second pin member including a second pin configured to be engaged with the second engagement hole, the second pin member being disposed with a distance from the first pin member in a width direction of the band, an operation member configured to move between a first position and a second position, a housing configured to hold the first pin member, the second pin member and the operation member, and a guide part configured to guide the first pin member and the second pin member to move between an engagement position and a release position with respect to the housing, the housing includes an engaging part configured to be engaged with the watch case, and a coupling part separated from the engaging part in a longitudinal direction of the band and configured to be coupled with the band main body, the first pin member and the second pin member move to the engagement position when the operation member is moved to the first position whereas the first pin member and the second pin member move to the release position when the operation member is moved to the second position, the engagement position is a position where the first pin and the second pin are located outside a side surface of the housing in the width direction of the band, and the engagement position is closer to the coupling part than the release position is in the longitudinal direction of the band orthogonal to the width direction, and the release position is a position where the first pin and the second pin are located inside the side surface of the housing in the width direction, and the release position is closer to the engaging part than the engagement position is in the longitudinal direction.

A watch of the present disclosure includes the above-described band.

A watch of the present disclosure includes a watch case including a first engagement hole and a second engagement hole facing each other, and a band including a band main body and an end member provided at an end portion of the band main body and attached to the watch case. The end member includes a first pin member including a first pin configured to be engageable with the first engagement hole, a second pin member including a second pin configured to be engageable with the second engagement hole and disposed with a distance from the first pin member in a width direction of the band, an operation member configured to be movable to a first position and a second position, and a housing configured to hold the first pin member, the second pin member and the operation member, and the first pin member and the second pin member are configured to be movable to an engagement position where the first pin member and the second pin member engage with the first engagement hole and the second engagement hole when the operation member is moved to the first position, and movable to a release position where the first pin member and the second pin member do not engage with the first engagement hole and the second engagement hole when the operation member is moved to the second position.

DESCRIPTION OF EXEMPLARY EMBODIMENTS

First Embodiment

A watch 1 according to a first embodiment of the present disclosure is described below with reference to the drawings.

Figure 1:
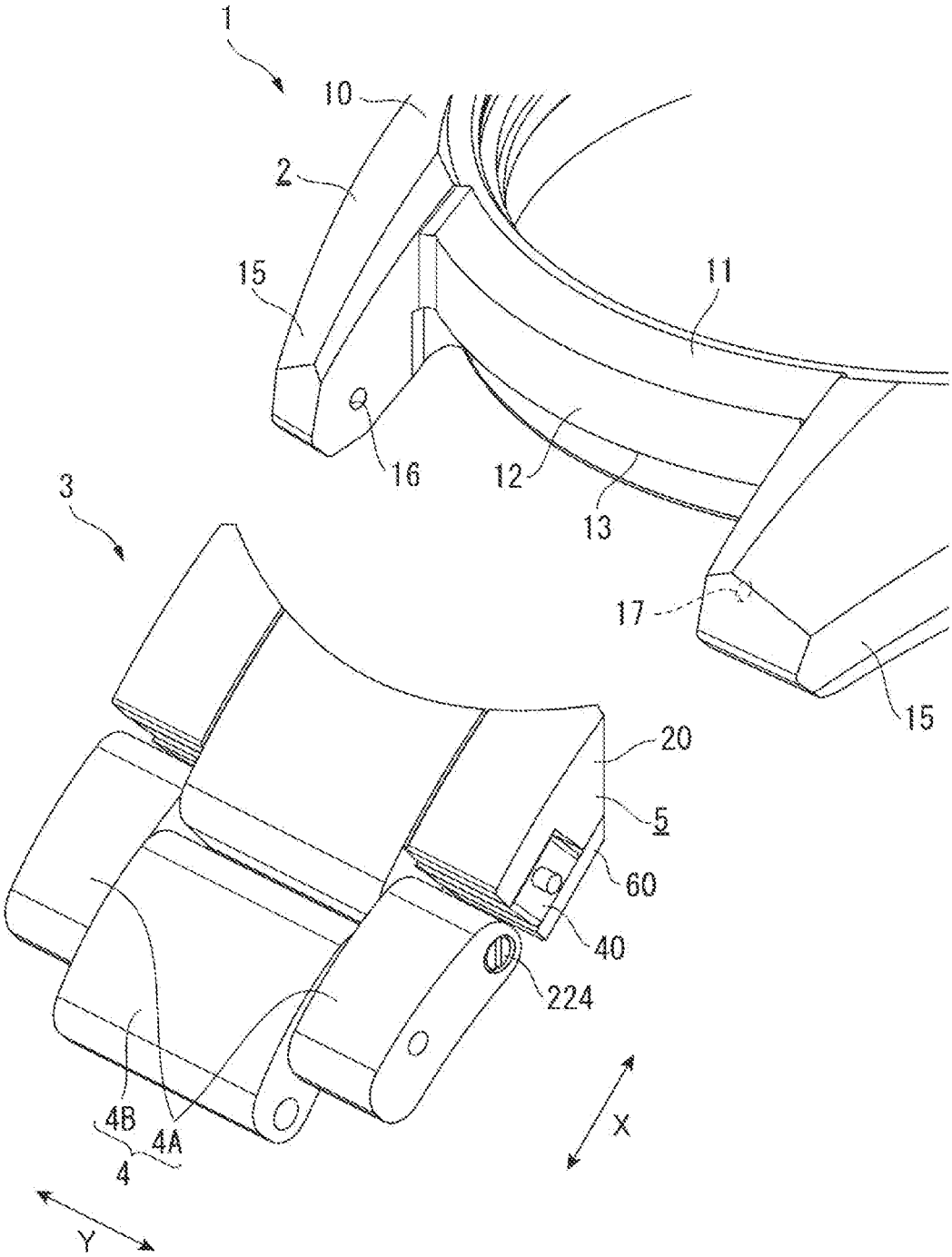
FIG. 1 is an exploded perspective view illustrating a main part of a watch of a first embodiment.

FIG. 1 is a perspective view illustrating a main part of the watch 1 of the first embodiment.

As illustrated in FIG. 1, the watch 1 includes a watch main body 2 and a band 3. Note that in the following description, the longitudinal direction of the band 3 is the X-axis direction, the width direction of the band 3 is the Y-axis direction, and the thickness direction of the band 3 is the Z-axis direction. The X axis, the Y axis, and the Z axis are directions orthogonal to each other.

The watch main body 2 includes a watch case 10, and a cover glass and a case back not illustrated in the drawing. The watch case 10 includes a case body 11 and a bow 15.

The case body 11 is a cylindrical member formed of metal, and a dial, a movement and the like not illustrated in the drawing are disposed inside the case body 11.

The bows 15 are provided on the 6 o'clock direction side and the 12 o'clock direction side of the case body 11. Each bow 15 is provided as a pair protruding from a side surface 12 of the case body 11, and a first engagement hole 16 and a second engagement hole 17 are formed in the opposing surfaces of each bow 15.

Band

As illustrated in FIG. 1, the band 3 includes a plurality of metal blocks 4 making up the band main body, and an end-piece 5 making up the end member. The block 4 includes an outer block 4A and an inner block 4B, and the end-piece 5 is coupled with the end portion of the band main body composed of the plurality of blocks 4 and attached to the bow 15. Note that FIG. 1 illustrates a part of the band 3 attached to the bow 15 on the 6 o'clock direction side of the watch 1.

End-Piece

Figure 2:
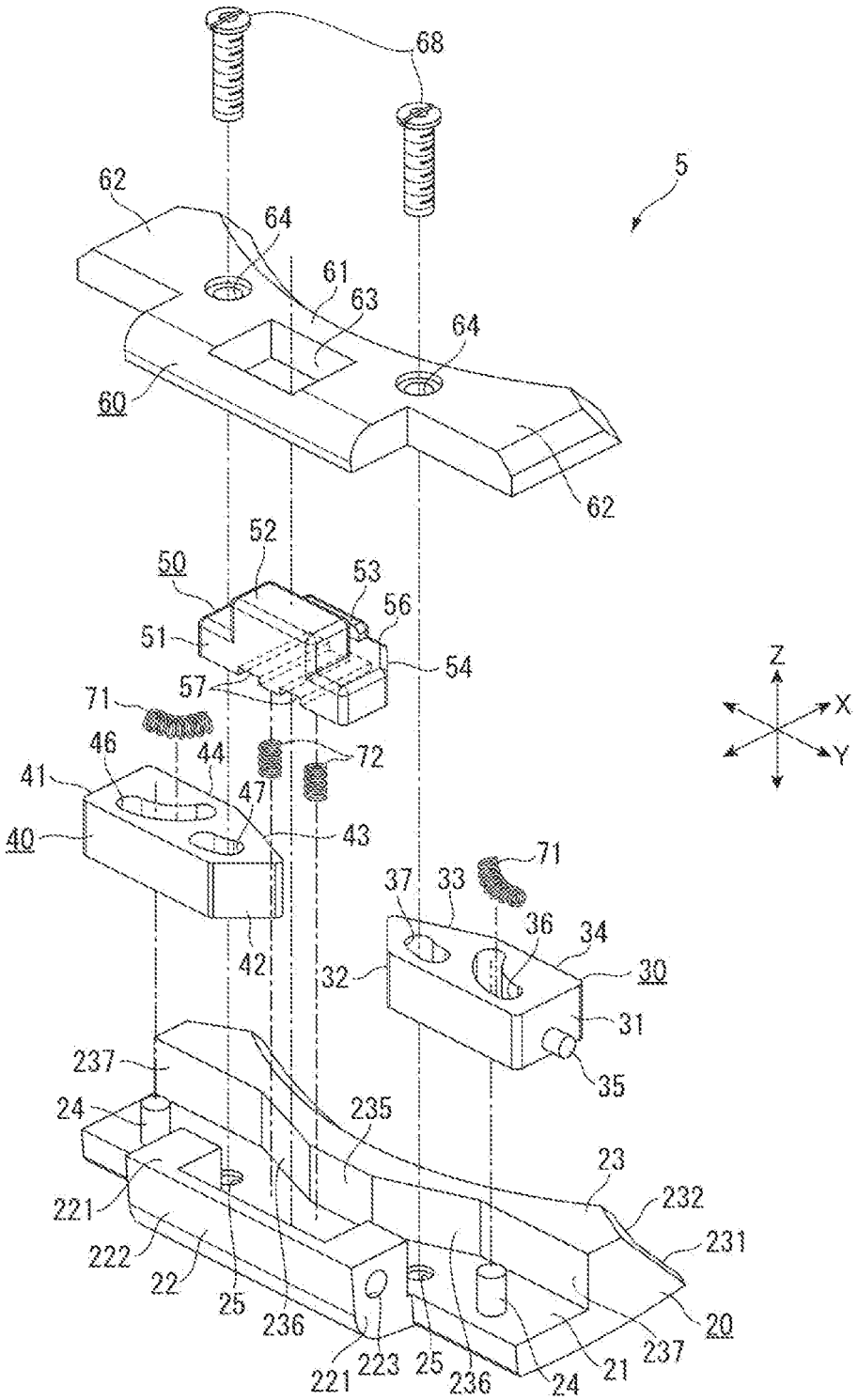
FIG. 2 is an exploded perspective view illustrating an end-piece of the first embodiment.
Figure 3:
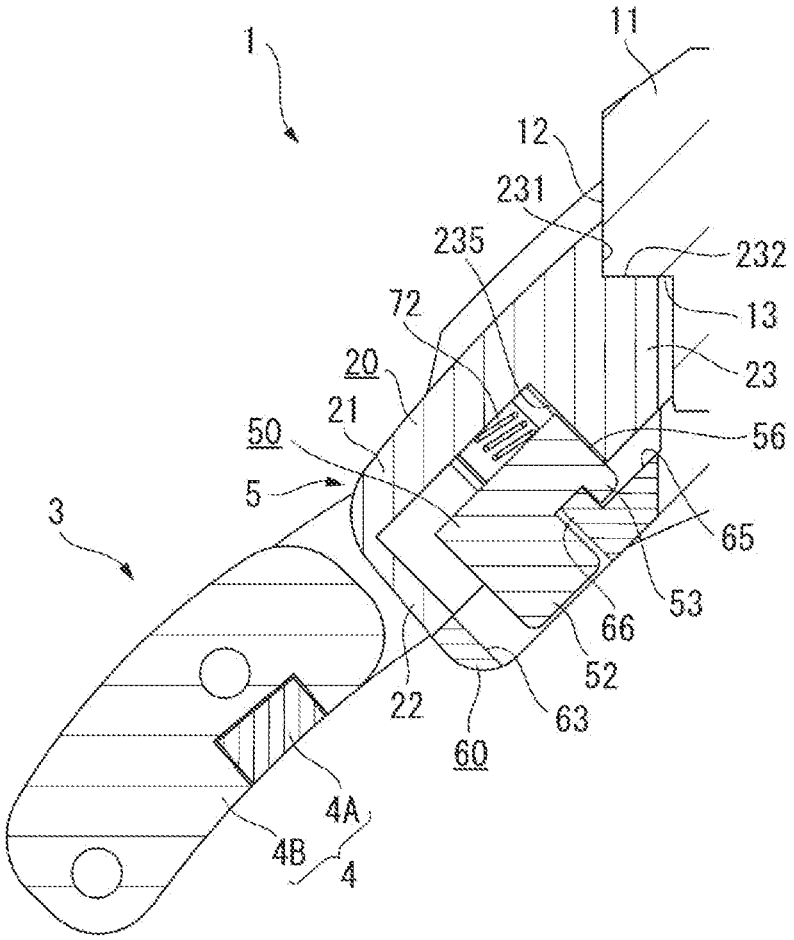
FIG. 3 is a sectional view illustrating the end-piece of the first embodiment.

FIG. 2 is an exploded perspective view of the end-piece 5 as viewed from the rear surface side, and FIG. 3 is a cross-sectional view of the end-piece 5 taken along a plane orthogonal to the Y-axis direction, which is the width direction of the band 3.

As illustrated in FIG. 2, the end-piece 5 includes a housing 20, a first pin member 30, a second pin member 40, an operation member 50, and a holder plate 60.

Housing

As illustrated in FIGS. 2 and 3, the housing 20 includes a base part 21, a coupling part 22, and an engaging part 23.

As illustrated in FIG. 1, the base part 21 is a plate-like portion exposed to the front surface side of the band 3 in the housing 20.

The coupling part 22 is provided at the end portion of the base part 21 on the block 4 side and includes a pair of guide walls 221 opposite to each other in the width direction of the band 3 and a coupling wall 222 that couples the guide walls 221. The coupling part 22 is formed in a substantially U-shape in plan view as viewed from the rear surface side of the housing 20. A hole 223 extending in the Y-axis direction is formed in each guide wall 221. The guide wall 221 is disposed between the outer blocks 4A, and the band main body composed of the outer block 4A, i.e., the plurality of blocks 4 is coupled to the coupling part 22 with a screw 224 inserted through the outer block 4A and the hole 223 as illustrated in FIG. 1.

As illustrated in FIGS. 2 and 3, the engaging part 23 is provided on the watch case 10 side of the base part 21, and makes contact with the corner portion composed the side surface 12 of the case body 11 and a bottom surface 13 formed in the direction orthogonal to the side surface 12. Specifically, the engaging part 23 includes a first engage surface 231 that engages with the side surface 12 and a second engage surface 232 that engages with the bottom surface 13.

Further, the engaging part 23 includes a wall surface that is upright from the base part 21 in the Z-axis direction. In the engaging part 23, the wall surface includes a contact surface 235 located at the center in the Y-axis direction to face the coupling wall 222 of coupling part 22, a pair of tilted surfaces 236 provided on both sides of the contact surface 235 and tilted with respect to the X-axis direction and the Y-axis direction, and a pair of flat surfaces 237 provided outside the tilted surface 236 extended along the Y-axis direction.

A pair of guide pins 24 protruding toward the rear surface side of the end-piece 5 is formed at the base part 21. The pair of guide pins 24 is provided at positions outside the coupling part 22 in the width direction of the housing 20. In addition, a pair of screw holes 25 to which a screw 68 described later is threadedly engaged is formed between the guide pins 24. The screw hole 25 is formed without penetrating the base part 21 so as not to open at the front surface of the end-piece 5.

The first pin member 30, the second pin member 40, and the operation member 50 are disposed in the recess surrounded by the base part 21, the coupling part 22, and the engaging part 23 of the housing 20. The first pin member 30 and the second pin member 40 are disposed apart in the Y-axis direction of the housing 20, and the operation member 50 is disposed therebetween.

First Pin Member and Second Pin Member

The first pin member 30 and the second pin member 40 are block-shaped members with substantially pentagonal shapes in plan view as viewed from the Z-axis direction.

The first pin member 30 includes an outer surface 31, a first tilted surface 32, a first contact tilted surface 33, a first contact flat surface 34, a first pin 35, a guide hole 36, and a fixation hole 37. The outer surface 31 is a surface exposed to the side surface of the end-piece 5, and protrudes in the Y-axis direction from the outer surface 31 of the first pin 35.

The first tilted surface 32 is a surface that faces the operation member 50 and is tilted with respect to the X-axis direction and the Y-axis direction. The first tilted surface 32 is a surface that is tilted toward the engaging part 23 side as it goes toward the top end side away from the outer surface 31, i.e., the center side in the width direction of the band 3 from the base end side closer to the outer surface 31.

The first contact tilted surface 33 is a surface that faces the tilted surface 236 of the engaging part 23, and the first contact flat surface 34 is a surface that faces a flat surface 237 of the engaging part 23. Note that the inclination direction of the first contact tilted surface 33 is different from that of the first tilted surface 32. Thus, the first pin member 30 has a shape, i.e., a tapered shape, whose dimension between the first tilted surface 32 and the first contact tilted surface 33 decreases as it goes toward the top end side away from the outer surface 31.

Figure 4:
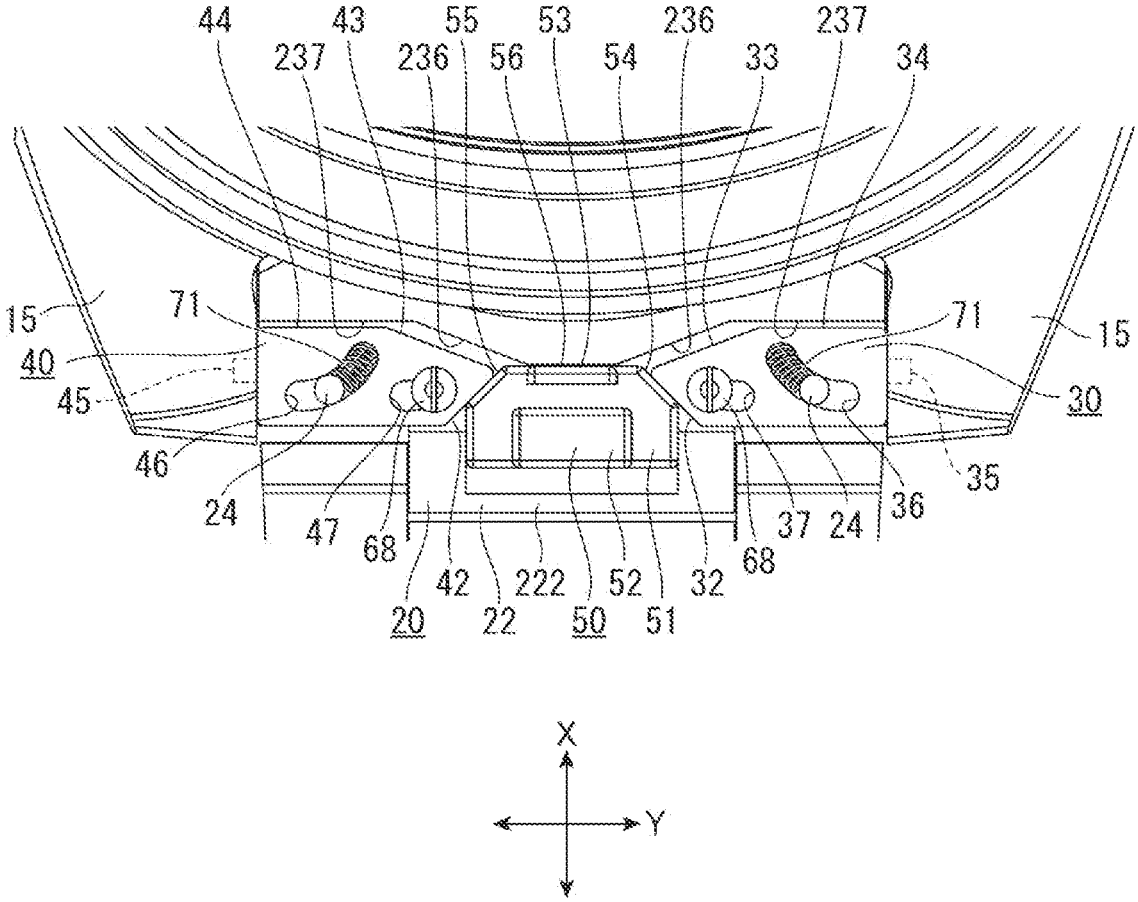
FIG. 4 is a plan view illustrating the end-piece of the first embodiment.

As illustrated in FIG. 4, the guide hole 36 is a long hole formed in an arc-like shape in plan view as viewed from the Z-axis direction, and is provided to extend through the first pin member 30 in the Z-axis direction. The guide hole 36, which is formed in an arc-like shape between the position close to the outer surface 31 and a position close to the first contact flat surface 34, has an inclination angle that is close to the X-axis direction in the plan view at a position close to the first contact flat surface 34 and becomes closer to the Y-axis direction as it goes toward the outer surface 31, i.e., toward the outside in the width direction of the band 3. Thus, the guide hole 36 has an inclination angle with which the displacement in the X-axis direction, which is the longitudinal direction of the band 3 is large relative to the displacement in the Y-axis direction, which is the width direction of the band 3 on the first contact flat surface 34 side, i.e., the center side in the width direction of the band 3. Further, the guide hole 36 is gradually changed to an inclination angle with which the displacement in the width direction of the band 3 is large relative to the displacement in the longitudinal direction of the band 3 as it goes toward the outside in the width direction of the band 3, i.e., the outer surface 31.

The fixation hole 37 is a long hole that is tilted with respect to the X-axis direction and the Y-axis direction in the plan view, and is provided to extend through the first pin member 30 as with the guide hole 36. Note that the inclination angle of the fixation hole 37 is an angle that is substantially the same as that of the guide hole 36 on the end portion side on the outer surface 31 side, i.e., an angle close to the Y axis.

The second pin member 40 is the same component as the first pin member 30, and is disposed in an orientation that is set by rotating the first pin member 30 180 degrees with the Z axis as the rotation axis, i.e., an orientation that is line-symmetric with respect to the symmetry axis extending along the X-axis direction passing through the center of the width direction of the band 3.

Specifically, the second pin member 40 includes an outer surface 41, a second tilted surface 42, a second contact tilted surface 43, a second contact flat surface 44, a second pin 45, a guide hole 46, and a fixation hole 47, which have the same configurations as those of the outer surface 31, the first tilted surface 32, the first contact tilted surface 33, the first contact flat surface 34, the first pin 35, the guide hole 36, and the fixation hole 37, respectively, of the first pin member 30. Therefore, description of the detailed configurations of the second pin member 40 will be omitted.

The guide pin 24 and a spring 71, which is a biasing member, are inserted to each of the guide holes 36 and 46 of the first pin member 30 and the second pin member 40. The spring 71 is a compression coil spring, and is disposed between the guide pin 24 and end portions of the guide holes 36 and 46 on the first contact flat surface 34 side and the second contact flat surface 44 side. With the spring 71, the pin members 30 and 40 are biased in a direction approaching each other.

The screw 68 is inserted to the fixation holes 37 and 47 of the first pin member 30 and the second pin member 40. The width size of the fixation holes 37 and 47 is greater than the outer diameter of the screw 68, and the pin members 30 and 40 including the fixation holes 37 and 47 are provided to be slidable with respect to the screw 68. The first pin member 30 and the second pin member 40 are guided by the guide pin 24 and the screw 68, and are slidable in the X-axis direction and the Y-axis direction in the housing 20. That is, the pin members 30 and 40 move along the inclination directions of the guide holes 36 and 46 and the fixation holes 37 and 47, respectively. At this time, the pin members 30 and 40 move to the engaging part 23 side in the X-axis direction when moving in a direction approaching each other in the Y-axis direction, and move to the coupling part 22 side in the X-axis direction when moving in a direction away from each other in the Y-axis direction.

Here, the position where the first pin 35 and the second pin 45 engage with the first engagement hole 16 and the second engagement hole 17 when the pin members 30 and 40 are moved in a direction away from each other as illustrated in FIG. 4 is defined as an engagement position.

Figure 5:
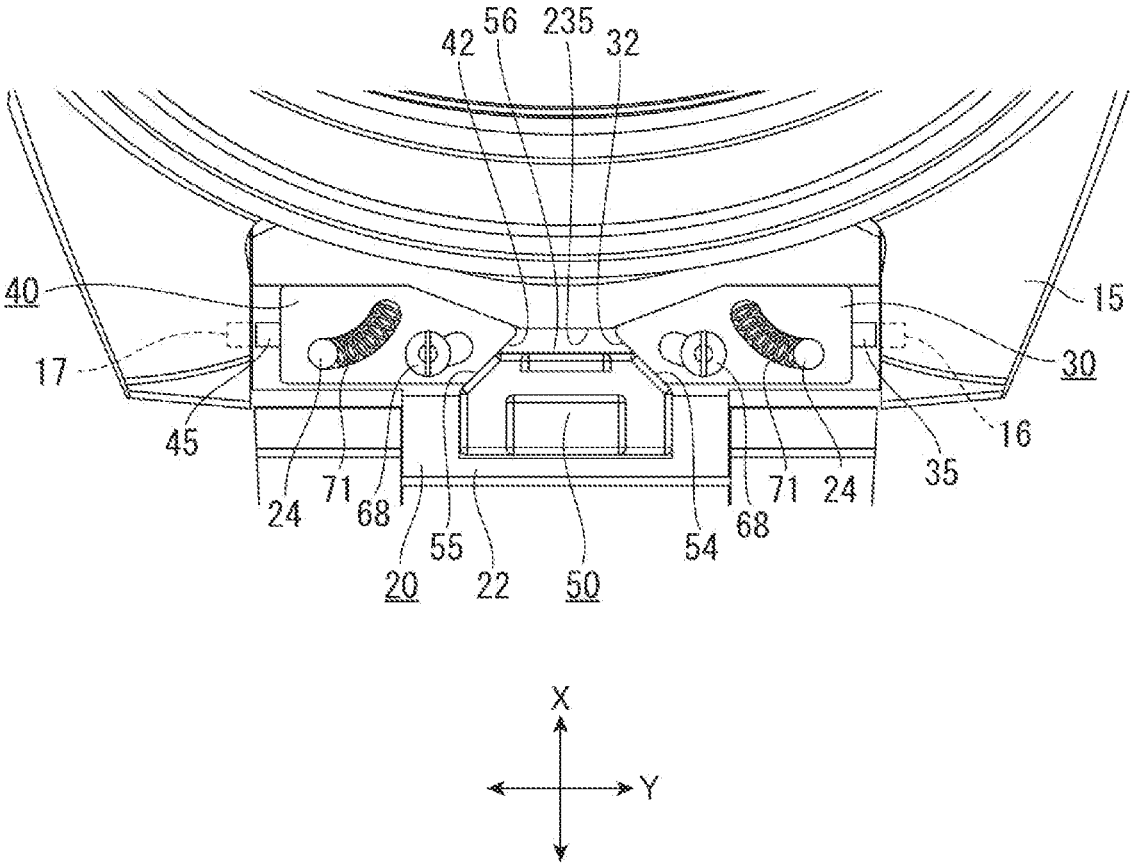
FIG. 5 is a plan view illustrating the end-piece of the first embodiment.

In addition, the position where the first pin 35 and the second pin 45 disengage from the first engagement hole 16 and the second engagement hole 17 when the pin members 30 and 40 are moved in a direction approaching each other as illustrated in FIG. 5 is defined as a release position. As illustrated in FIG. 5, when the pin members 30 and 40 move to the release position, the first contact tilted surface 33 and the second contact tilted surface 43 make contact with the pair of tilted surfaces 236, and the first contact flat surface 34 and the second contact flat surface 44 make contact with the pair of flat surfaces 237.

As illustrated in FIGS. 2 to 4, the operation member 50 includes a base plate part 51, a button part 52, a lock wall part 53, a first guide surface 54, a second guide surface 55, a contact surface 56, and a holding groove 57. The operation member 50 is disposed between the pair of guide walls 221 so as to be movable in the X-axis direction along the guide wall 221.

The base plate part 51 is a plate-shaped portion with a hexagonal shape in plan view as viewed from the Z-axis direction, and the both side surfaces are guided by the guide wall 221 in contact with it.

The button part 52 is provided to protrude from the base plate part 51 to the rear surface side of the end-piece 5 i.e., the Z-axis direction. As described later, the button part 52 is an operation part that is operated by the user of the watch 1 when the end-piece 5 is attached to or detached from the watch case 10.

The lock wall part 53 is a wall part protruded to the Z-axis direction from the end portion of the base plate part 51 on the engaging part 23 side.

The first guide surface 54 is a surface that faces the first tilted surface 32 of the first pin member 30 at the side surface of the base plate part 51. The second guide surface 55 is a surface that faces the second tilted surface 42 of the second pin member 40 at the side surface of the base plate part 51. Thus, the first guide surface 54 and the second guide surface 55 are tilted in a direction approaching each other from the coupling part 22 side toward the engaging part 23 side in the X-axis direction.

The contact surface 56 is a surface that faces the contact surface 235 at the side surface of the base plate part 51. The holding groove 57 is a groove along the X-axis direction at the bottom surface of the base plate part 51 on the base part 21 side, and two holding grooves 57 are formed in the present embodiment.

Here, when the pin members 30 and 40 are biased by the spring 71, the first tilted surface 32 of the first pin member 30 makes contact with the first guide surface 54 of the operation member 50 at all times, and the second tilted surface 42 of the second pin member 40 makes contact with the second guide surface 55 of the operation member 50 at all times.

Therefore, as illustrated in FIG. 4, in the state where the operation member 50 is moved to the engaging part 23 side and the contact surface 56 are in contact with the contact surface 235, the first guide surface 54 and the second guide surface 55 make contact with the top end sides of the first tilted surface 32 and the second tilted surface 42, and the first pin member 30 and the second pin member 40 are moved to a direction away from each other against the biasing force of the spring 71, i.e., to the engagement position where the first pin 35 and the second pin 45 engage with the first engagement hole 16 and the second engagement hole 17.

On the other hand, as illustrated in FIG. 5, in the state where the operation member 50 is moved to the coupling part 22 side and the operation member 50 is in contact with the coupling wall 222, the first guide surface 54 and the second guide surface 55 make contact with the base end sides of the first tilted surface 32 and the second tilted surface 42, and the first pin member 30 and the second pin member 40 are moved to a direction approaching each other with the biasing force of the spring 71, i.e., to the release position where the first pin 35 and the second pin 45 disengage from the first engagement hole 16 and the second engagement hole 17.

Here, the position where the operation member 50 is moved to the engaging part 23 side, i.e., the position of the operation member 50 where the first pin member 30 and the second pin member 40 are located at the engagement position is defined as a first position. In addition, the position where the operation member 50 is moved to the coupling part 22 side, i.e., the position of the operation member 50 where the first pin member 30 and the second pin member 40 are located at the release position is defined as a second position.

A spring 72 is disposed at each holding groove 57 of the operation member 50 as illustrated in FIGS. 2 to 4. The spring 72 is a compression coil spring disposed between the base part 21 and the holding groove 57, and biases the operation member 50 to the rear surface side of the end-piece 5 in the Z-axis direction, i.e., the direction away from the base part 21. Thus, a second biasing member is configured with the spring 72.

The holder plate 60 includes a lid part 61, and a pair of holding parts 62 protruded from the lid part 61 to the both sides in the width direction of the band 3.

In the lid part 61, which is disposed over the coupling part 22 and the engaging part 23, an operation hole 63 where the button part 52 is disposed and a screw hole 64 where the screw 68 is disposed are formed. By threadedly engaging the screw 68 disposed in the screw hole 64 with the screw hole 25 through the fixation holes 37 and 47 of the pin members 30 and 40, the holder plate 60 is fixed to the housing 20. The base plate part 51 of the operation member 50 is sandwiched and held by the housing 20 and the holder plate 60, and the button part 52 is disposed in the operation hole 63.

In addition, the holding part 62 is disposed on the rear surface side of each of the pin members 30 and 40. Thus, each of the pin members 30 and 40 is disposed in a sandwiched manner between the housing 20 and the holding part 62.

As illustrated in FIG. 3, a recess 65 where the lock wall part 53 can be disposed is formed in the surface of the lid part 61 on the operation member 50 side. In the holder plate 60, a lock part 66 is formed between the recess 65 and the operation hole 63, and the movement of the operation member 50 to the second position is restricted in the state where the lock wall part 53 is disposed in the recess 65, i.e., in the state where the operation member 50 is located at the first position. Thus, a movement restriction part is configured with the lock wall part 53 of the operation member 50.

Attaching/Detaching Operation Procedure of End-Piece

Next, an operation of attaching/detaching the end-piece 5 of the band 3 to/from the watch case 10 is described.

Attaching Procedure of End-Piece

Figure 6:
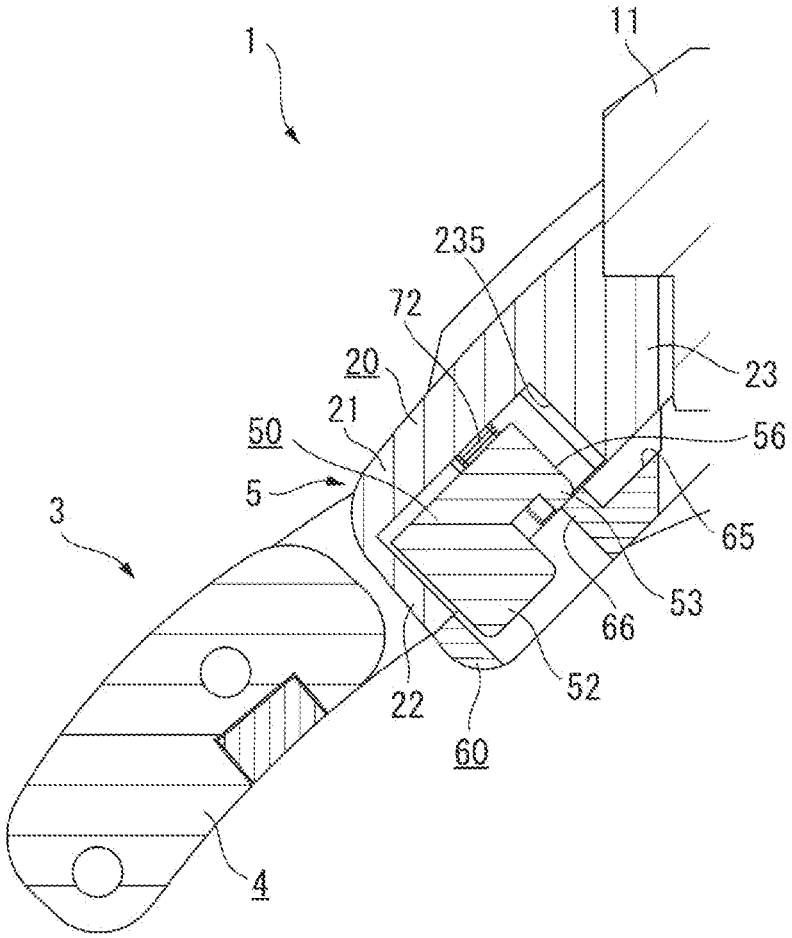
FIG. 6 is a sectional view illustrating the end-piece of the first embodiment.

When attaching the end-piece 5 to the watch case 10, the operation member 50 is moved to the position of the coupling part 22 side, i.e., the second position as illustrated in FIG. 5. In this case, as illustrated in FIG. 6, the operation member 50 is disposed at a position close to the base part 21 with the lock wall part 53 in contact with the lock part 66, and the spring 72 pushed.

In this state, as illustrated in FIG. 5, the pin members 30 and 40 are moved to the release position where the first pin 35 and the second pin 45 are retracted from the side surface of the housing 20. Thus, the user can place the end-piece 5 between the bows 15. Then, the user places the end-piece 5 at a position where the first engage surface 231 and the second engage surface 232 of the engaging part 23 make contact with the side surface 12 and the bottom surface 13 of the watch case 10.

Next, the user moves the operation member 50 to the engaging part 23 side, i.e., the first position by operating the button part 52 in the operation hole 63. Then, as illustrated in FIGS. 3 and 4, the pin members 30 and 40 are moved in a direction away from each other against the biasing force of the spring 71 to the engagement position where the first pin 35 and the second pin 45 engage with the first engagement hole 16 and the second engagement hole 17.

In addition, along with the movement of the pin members 30 and 40, the guide pins 24 are separated from the end portions of the guide holes 36 and 46 on the outer surfaces 31 and 41 side by being guided by the guide holes 36 and 46, and are moved to the watch case 10 side in the X-axis direction. That is, the housing 20 including the guide pin 24 is pushed to the watch case 10 side with respect to the pin members 30 and 40, and the housing 20 of the end-piece 5 is pressed against the watch case 10, thus preventing generation of gaps and backlash between the end-piece 5 and the watch case 10 and improving the external appearance.

In addition, when the hand is detached from the button part 52 at the first position where the operation member 50 is in contact with the contact surface 235, the operation member 50 moved by the spring 72 to the rear surface side and the lock wall part 53 engages with the recess 65 as illustrated in FIG. 3. In this state, the lock wall part 53 is locked by the lock part 66, and the movement of the operation member 50 to the coupling part 22 side is also restricted. Thus, the state where the first pin 35 and the second pin 45 engage with the first engagement hole 16 and the second engagement hole 17 can be reliably maintained.

Detaching Procedure of End-Piece

Next, a procedure of detaching the end-piece 5 from the watch case 10 is described.

From the attached state of FIGS. 3 and 4, the lock wall part 53 is removed from the recess 65 by pushing the button part 52, and further the button part 52 is moved to the coupling part 22 side, i.e., the second position. Then, as illustrated in FIGS. 5 and 6, the pin members 30 and 40 are biased by the spring 71 and moved in a direction approaching each other, and the pin members 30 and 40 are moved to the release position where the first pin 35 and the second pin 45 disengage from the first engagement hole 16 and the second engagement hole 17. In this manner, the end-piece 5 can be removed from the watch case 10.

Operational Effects of First Embodiment

The end-piece 5 can be attached to or detached from the watch case 10 by operating the operation member 50 by the user. Then, with the guide holes 36 and 46 and the fixation holes 37 and 47 that are formed in the pin members 30 and 40 and are tilted with respect to the Y-axis direction in which the first pin 35 and the second pin 45 extend, the housing 20 can be pressed against the case body 11 of the watch case 10 when the pin members 30 and 40 are moved to the bow 15 side and the end-piece 5 is attached to the watch case 10. In this manner, generation of gaps and backlash between the end-piece 5 and the watch case 10 can be prevented, and the external appearance can be improved.

When the operation member 50 is moved forward or backward in the longitudinal direction of the band 3, the pin members 30 and 40 can be moved in the width direction of the band 3 because the first tilted surface 32 and the second tilted surface 42, and the first guide surface 54 and the second guide surface 55 tilted with respect to the width direction and the longitudinal direction of the band 3 are in contact with each other with the spring 71. Thus, since the structure of moving the pin members 30 and 40 in linkage with the operation of the operation member 50 can be achieved in a simple configuration with a small number of components, a structure suitable for the band 3 of the watch 1 can be achieved in a cost-effective manner.

The guide part that movably guides the first pin member 30 and the second pin member 40 between the engagement position and the release position is composed of the guide holes 36 and 46 and the guide pin 24, which can be achieved with a simple structure in a space-saving manner, and thus the structure suitable for the band of the watch 1 can be achieved in a cost-effective manner.

Since the guide holes 36 and 46 are provided with arc shapes, the first pin 35 and the second pin 45 of the pin members 30 and 40 can be easily inserted to the first engagement hole 16 and the second engagement hole 17, and the force of pressing the housing 20 against the watch case 10 can be increased after the first pin 35 and the second pin 45 are engaged with the first engagement hole 16 and the second engagement hole 17.

The pin members 30 and 40 and the operation member 50 can be reliably held by the housing 20 and the holder plate 60, and further, the pin members 30 and 40 and the operation member 50 can be prevented from being exposed to the outside, thus improving the external appearance by achieving a simple external appearance.

Second Embodiment

A second embodiment of the present disclosure is described below with reference to FIGS. 7 to 10.

Figure 7:
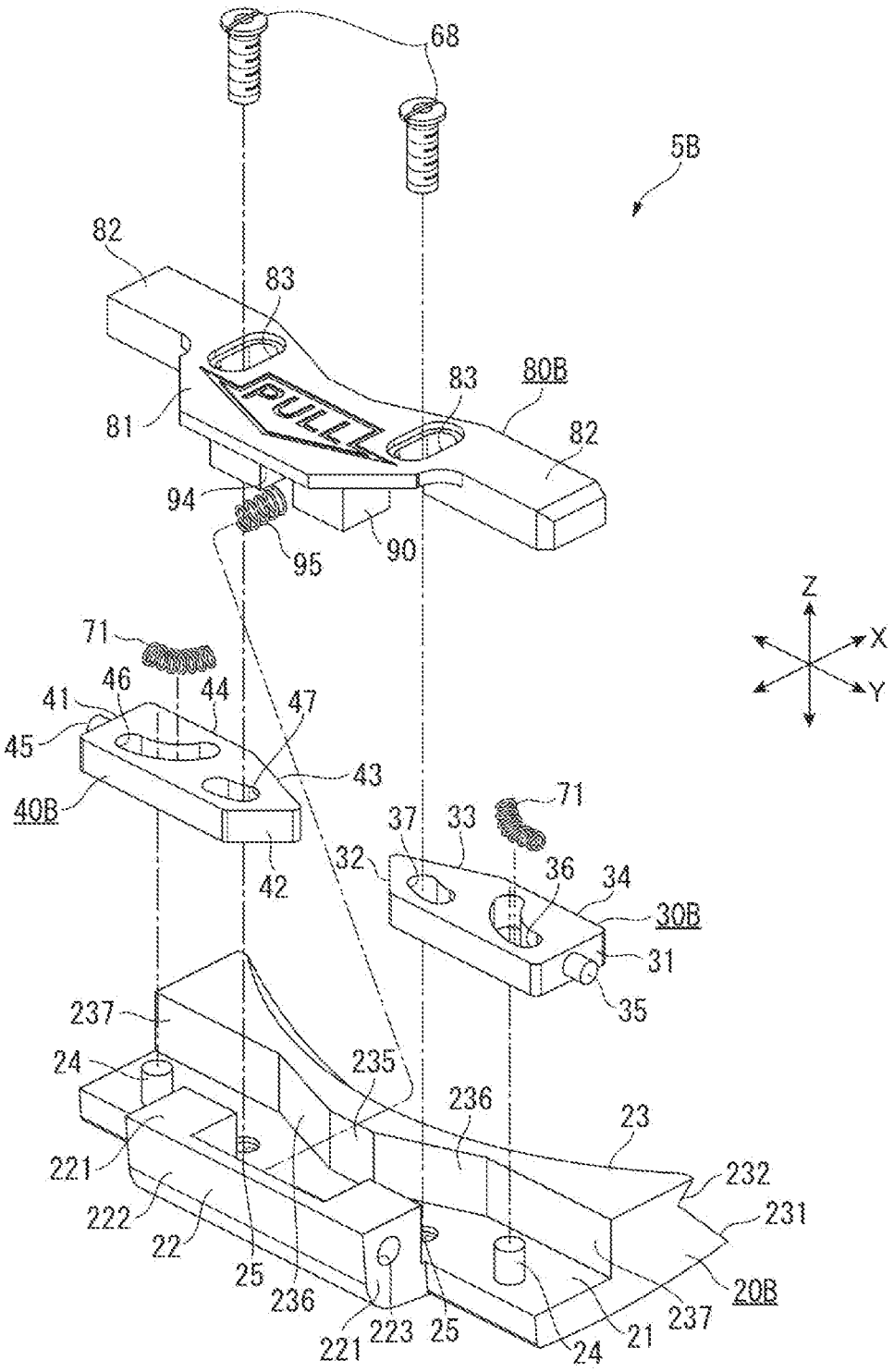
FIG. 7 is an exploded perspective view illustrating an end-piece of a second embodiment.

The second embodiment is different from the first embodiment in the configuration of an end-piece 5B. As illustrated in FIG. 7, the end-piece 5B includes a housing 20B, a first pin member 30B, a second pin member 40B, and an operation member 80B.

The housing 20B is different from the housing 20 of the first embodiment in the shape of both end portions of the engaging part 23, but other configurations are the same, and therefore the description thereof will be omitted by providing them with the same reference numeral.

The first pin member 30B and the second pin member 40B are different from the first pin member 30 and the second pin member 40 of the first embodiment in that the thickness is smaller, but other configurations are the same, and therefore the description thereof will be omitted by providing them with the same reference numeral.

In addition, as in the first embodiment, the spring 71 that biases the first pin member 30B and the second pin member 40B in a direction approaching each other is disposed in each of the first pin member 30B and the second pin member 40B.

Figure 8:
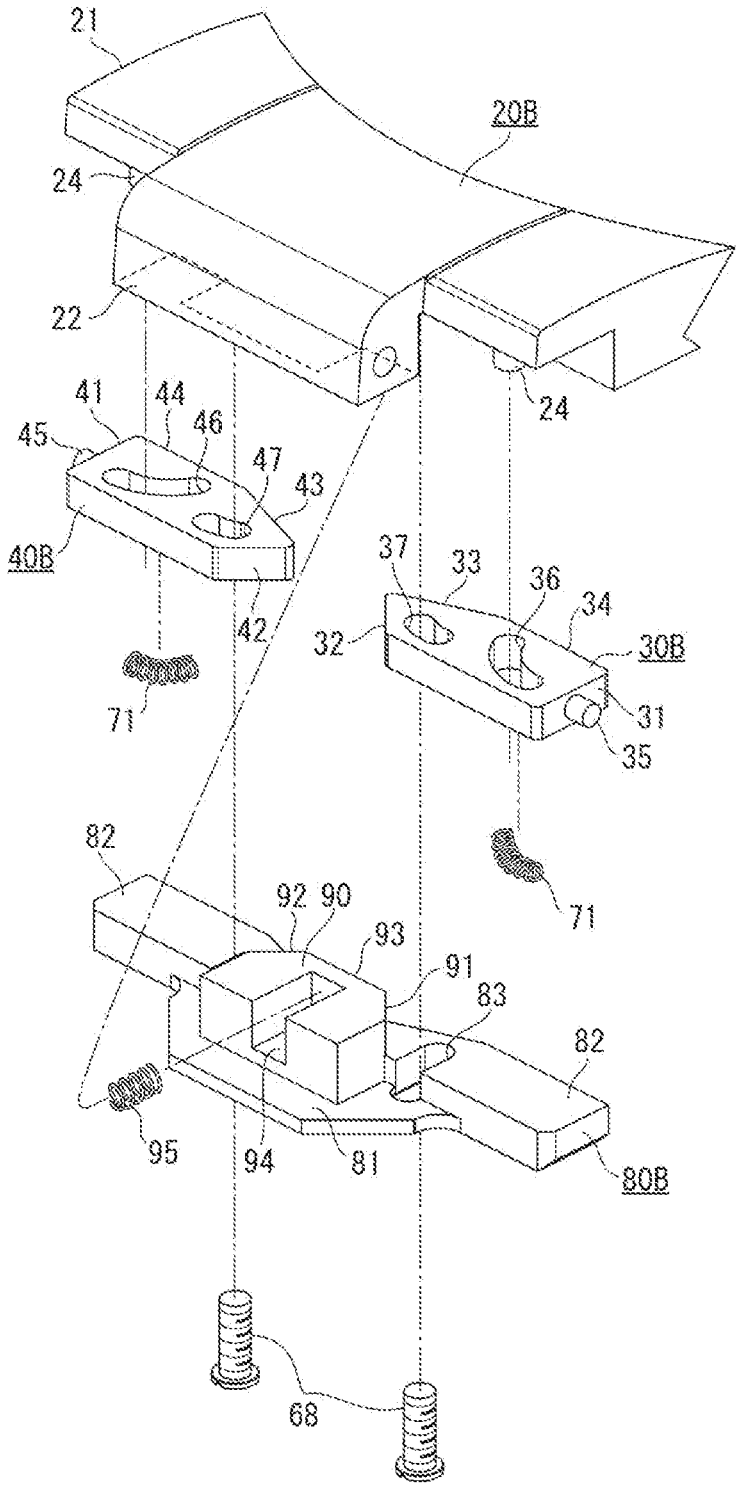
FIG. 8 is an exploded perspective view illustrating the end-piece of the second embodiment.

As illustrated in FIGS. 7 and 8, the operation member 80B has a structure in which the operation member 50 and the holder plate 60 of the first embodiment are integrated with each other. Specifically, the operation member 80B includes an operation plate part 81, a pair of holder plate parts 82, a pair of long holes 83 formed in each holder plate part 82, and an operation main body part 90 integrally formed at a surface of the operation plate part 81 on the base part 21 side.

The operation plate part 81 is a portion engraved with the word "PULL" for slide operation by the user.

The pair of holder plate parts 82 protrudes to the left and right ends from the operation plate part 81 and covers the first pin member 30B and the second pin member 40B, respectively. In addition, the end surface of the holder plate part 82 on the watch case 10 side has a shape that can make contact with the contact surface 235, the tilted surface 236, and the flat surface 237 of the engaging part 23.

The pair of long holes 83 is holes elongated along the X-axis direction and formed through the holder plate part 82. The screw 68 is disposed in each long hole 83, and the operation member 80B is disposed to be movable in the X-axis direction.

As illustrated in FIG. 8, the operation main body part 90 includes a first guide surface 91, a second guide surface 92, a contact surface 93, and a holding groove 94. The operation main body part 90 is disposed between the pair of guide walls 221 so as to be movable in the X-axis direction along the guide wall 221.

The first guide surface 91 is a guide surface similar to the first guide surface 54, and is a surface that faces the first tilted surface 32 of the first pin member 30B at the side surface of the operation main body part 90. The second guide surface 92 is a guide surface similar to the second guide surface 55, and is a surface that faces the second tilted surface 42 of the second pin member 40B at the side surface of the operation main body part 90. As such, the first guide surface 91 and the second guide surface 92 are tilted in a direction approaching each other from the coupling part 22 side toward the engaging part 23 side in the X-axis direction.

The contact surface 93 is a surface that faces the contact surface 235 at the side surface of the operation main body part 90. The holding groove 94 is a groove that extends along the X-axis direction and opens to the bottom surface on the base part 21 side and the coupling part 22 side in the operation main body part 90.

A spring 95, which is a third biasing member, is disposed in the holding groove 94. The spring 95 is a compression coil spring disposed between it and the coupling wall 222 to bias the operation member 80B to the engaging part 23 side. Note that preferably, the biasing force of the spring 95 can move the operation member 80B to the first position, i.e., in a direction in which the pin members 30 and 40 are separated away from each other, and, for example, it suffices to be a biasing force greater than the sum of the biasing forces of two springs 71.

Attaching/Detaching Operation Procedure of End-Piece

Figure 9:
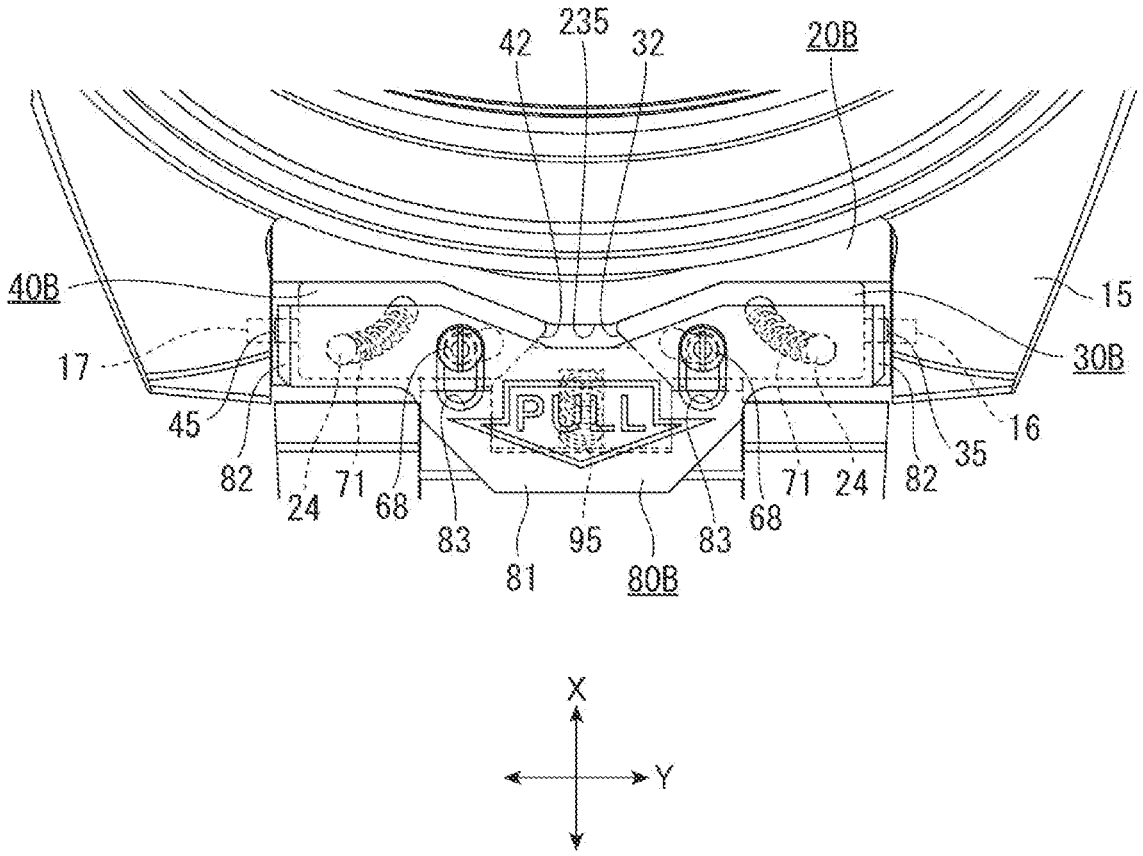
FIG. 9 is a plan view illustrating the end-piece of the second embodiment.

As illustrated in FIG. 9, in the end-piece 5B of the second embodiment, when the user operates the operation plate part 81 of the operation member 80B to slide the operation member 80B to the second position in the direction indicated as "PULL", i.e., in the direction of the block 4 side of the band 3, the contact positions of the first guide surface 91 and the second guide surface 92 of the operation main body part 90 are moved to the base end sides of the first tilted surface 32 and the second tilted surface 42 of the first pin member 30B and the second pin member 40B. Thus, the first pin member 30B and the second pin member 40B are moved in a direction approaching each other with the biasing force of the spring 71, and moved to the release position where the first pin 35 and the second pin 45 disengage from the first engagement hole 16 and the second engagement hole 17. Thus, the user can detach the end-piece 5B from the watch case 10.

On the other hand, when attaching the end-piece 5B to the watch case 10, the operation plate part 81 is slid to the block 4 side of the band 3 to move the operation member 80B to the second position as illustrated in FIG. 9, and the end-piece 5B is disposed between the bows 15 in the state where the first pin 35 and the second pin 45 do not protrude from the side surface of the end-piece 5B.

Next, when the user detaches the hand from the operation plate part 81, the operation member 80B moves to the watch case 10 side with the biasing force of the spring 95. Note that at this time, the operation plate part 81 may be moved to the watch case 10 side through the user operation.

Figure 10:
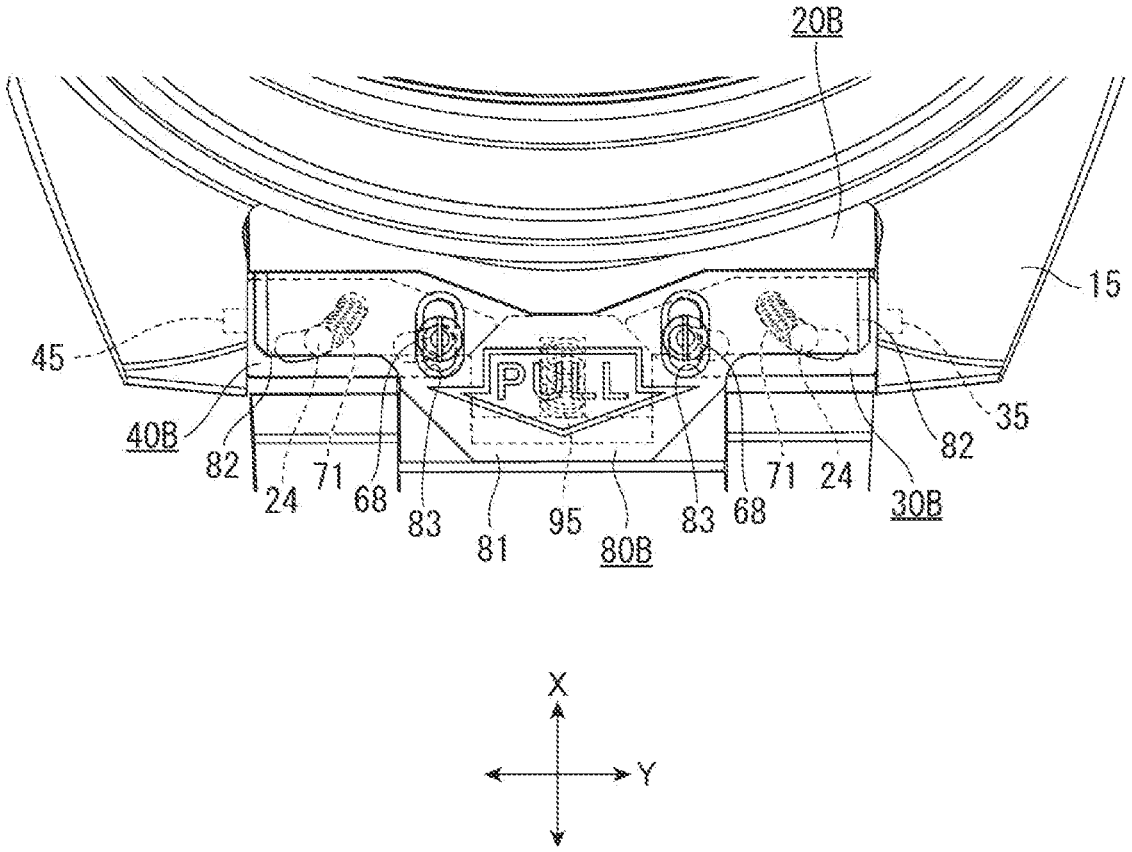
FIG. 10 is a plan view illustrating the end-piece of the second embodiment.

When the operation member 80B is moved to the first position on the watch case 10 side, the contact positions of the first guide surface 91 and the second guide surface 92 of the operation main body part 90 move to the top end sides of the first tilted surface 32 and the second tilted surface 42 of the first pin member 30B and the second pin member 40B as illustrated in FIG. 10. Thus, the first pin member 30B and the second pin member 40B move in a direction away from each other, and move to the engagement position where the first pin 35 and the second pin 45 engage with the first engagement hole 16 and the second engagement hole 17. Thus, the end-piece 5B can be attached to the watch case 10.

Operational Effects of Second Embodiment

With the operation member 80B of the second embodiment, the same operational effects as those of the first embodiment can be achieved.

Further, since the operation member 80B includes the holder plate part 82 that holds the pin members 30B and 40B between it and the housing 20B, the number of components can be reduced in comparison with the first embodiment. In addition, the operation member 80B integrated with the holder plate part 82 can reduce the size in comparison with the operation member 50, and can improve the operability of the user because it is entirely exposed at the rear surface of the end-piece 5B.

Modification

The present disclosure is not limited to the above-described embodiments, and modifications, improvements, and the like within the scope in which the object of the present disclosure can be achieved are included in the present disclosure.

For example, the configurations of the first pin members 30 and 30B and the second pin members 40 and 40B are not limited to the configurations of the embodiments.

Figure 11:
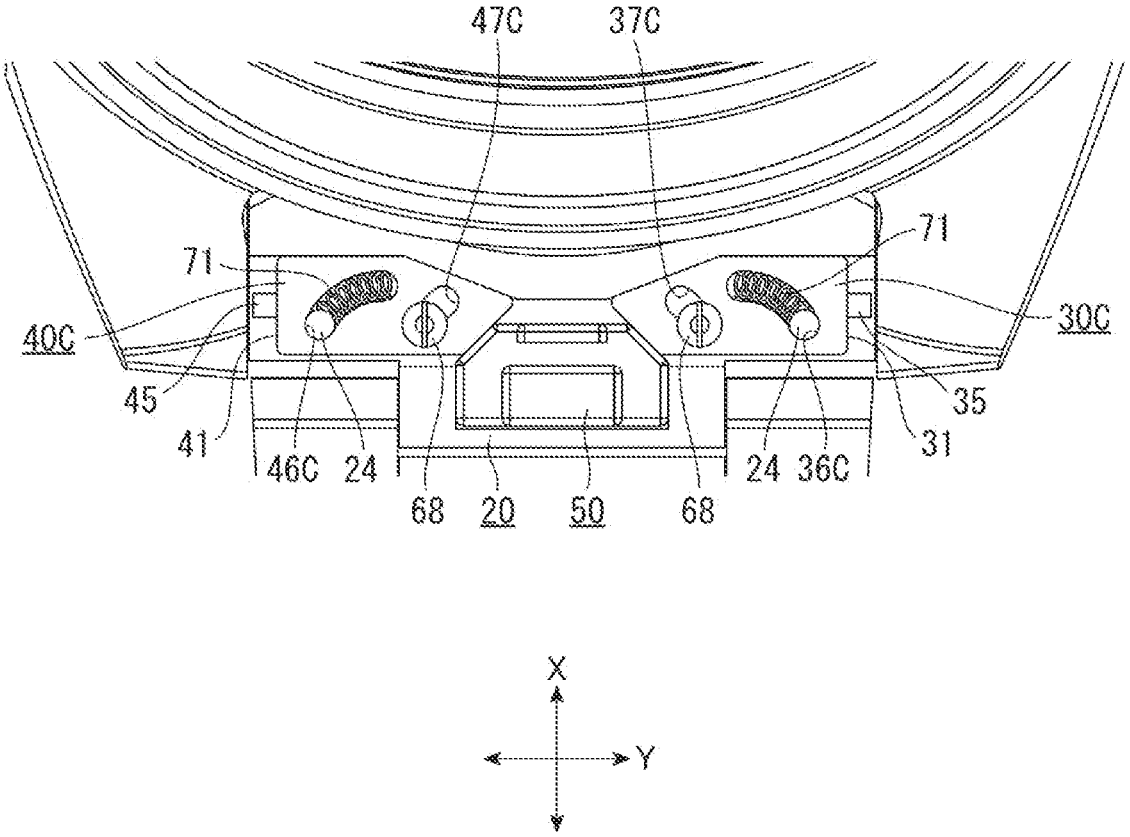
FIG. 11 is a plan view illustrating an end-piece of a modification.

For example, as illustrated in FIG. 11, it is possible to use a first pin member 30C and a second pin member 40C including guide holes 36C and 46C of inverted arcs, and fixation holes 37C and 47C with inclination angles corresponding to the guide holes 36C and 46C. The guide holes 36C and 46C are configured with an inclination angle with which the displacement in the X-axis direction, which is the longitudinal direction of the band 3, is small relative to the displacement in the Y-axis direction, which is the width direction of the band 3 at the center side in the width direction of the band 3, and is gradually changed to an inclination angle with which the displacement in the width direction of the band 3 is small relative to the displacement in the longitudinal direction of the band 3 as it goes toward the outside in the width direction of the band 3, i.e., the outer surfaces 31 and 41. The inclination angles of the fixation holes 37C and 47C are set to angles that are substantially the same as those of the guide holes 36C and 46C on the end portion sides on the outer surface 31 side. By using the first pin member 30C and the second pin member 40C described above, design variations can be increased.

Figure 12:
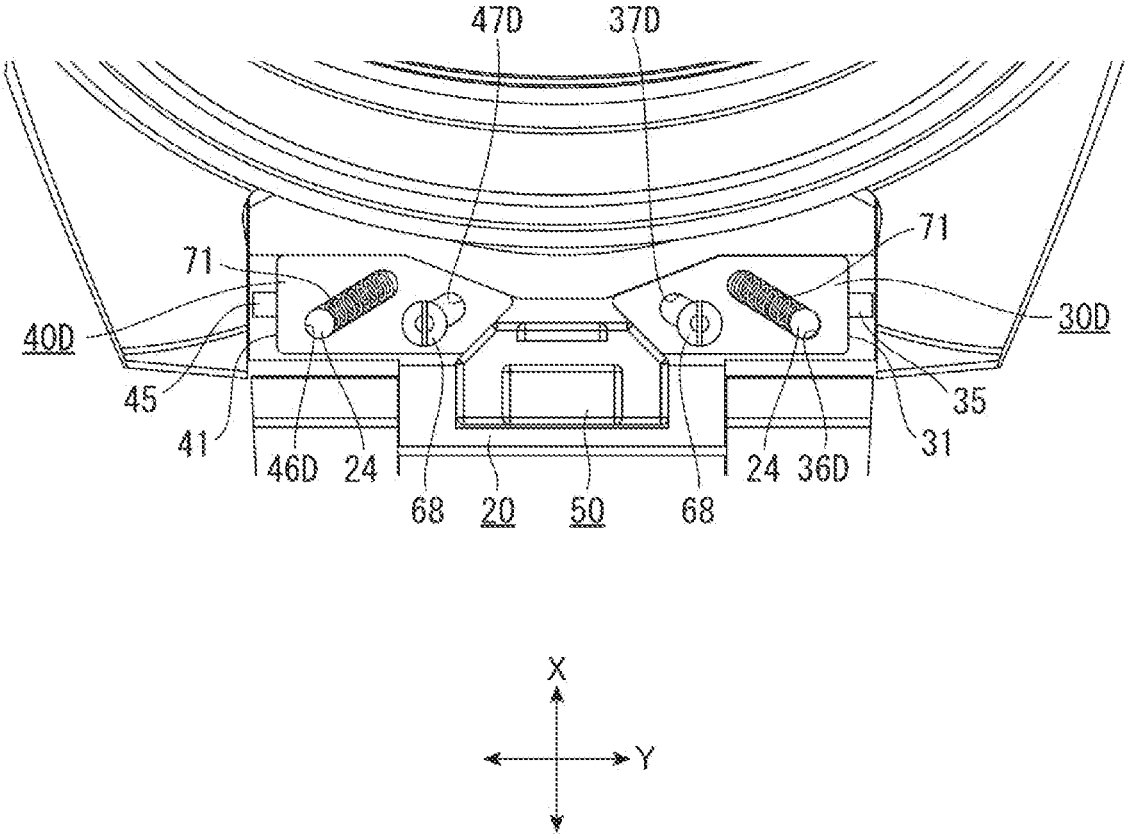
FIG. 12 is a plan view illustrating an end-piece of another modification.

In addition, as illustrated in FIG. 12, it is possible to use a first pin member 30D and a second pin member 40D including linear guide holes 36D and 46D and fixation holes 37D and 47D. In such first pin member 30D and second pin member 40D, the guide holes 36D and 46D can be more easily processed in comparison with the processing into the arc shape, and therefore the cost can be reduced.

Further, the guide hole may have a combination of straight and arc shapes. Specifically, as illustrated in FIGS. 4 and 5, because the guide pin 24 is moved in a partial range in the guide holes 36 and 46, the movement range of the guide pin 24 may be formed in an arc shape while forming the other portion where the spring 71 is disposed in a linear shape.

While the guide pin 24 is provided in the housings 20 and 20B and the guide holes 36 and 46 are formed in the first pin members 30 and 30B and the second pin members 40 and 40B in the embodiments, a guide groove may be formed in the base part 21 of the housings 20 and 20B, and a guide pin that is guided by the guide groove may be provided in the first pin members 30 and 30B and the second pin members 40 and 40B.

Further, a guide groove may be formed also in the holder plate 60 and/or the operation member 80B, and a guide pin may be provided at both surfaces of the first pin members 30 and 30B and the second pin members 40 and 40B.

In the end-piece 5 of the first embodiment, the operation member 50 is moved to the watch case 10 side through user operation, but a spring that biases the operation member 50 to the watch case 10 side may be provided to move it with the biasing force of the spring as in the second embodiment. At this time, the operation member 50 may be biased to the watch case 10 side by providing a compression coil spring between the operation member 50 and the coupling part 22, and the operation member 50 may be pulled to the watch case 10 side by providing a tensile coil spring between the operation member 50 and the engaging part 23. In addition, a tensile coil spring may be disposed between the first pin members 30 and 30B and the second pin members 40 and 40B.

The end member of the band 3 is not limited to the end-pieces 5 and 5B. For example, in a band provided with no end-piece, a block provided at the end portion of the band 3 may be used instead of the end-piece.

The structure that moves the first pin member and the second pin member in linkage with the movement of the operation member is not limited to the structure of the embodiment, and may be achieved by using a link mechanism or the like, for example.

While the holder plate 60 is provided in the first embodiment, the holder plate 60 may not be provided. For example, it suffices to adopt a configuration that can hold the pin members 30 and 40 and the operation member 50 at the housing 20 without providing the holder plate 60 by disposing the base plate part 51 of the operation member 50 between the base part 21 of the housing 20 and the pin members 30 and 40 by inserting a screw to each of the guide holes 36 and 46 and the fixation holes 37 and 47 of the pin members 30 and 40 to threadedly engage it to the housing 20.

Overview of The Present Disclosure

A band of the present disclosure is configured to be attached to a watch case including a first engagement hole and a second engagement hole facing each other, the band including a band main body, and an end member provided at an end portion of the band main body. The end member includes a first pin member including a first pin configured to be engaged with the first engagement hole, a second pin member including a second pin configured to be engaged with the second engagement hole, the second pin member being disposed with a distance from the first pin member in a width direction of the band, an operation member configured to move between a first position and a second position, a housing configured to hold the first pin member, the second pin member and the operation member, and a guide part configured to guide the first pin member and the second pin member to move between an engagement position and a release position with respect to the housing, the housing includes an engaging part configured to be engaged with the watch case, and a coupling part separated from the engaging part in a longitudinal direction of the band and configured to be coupled with the band main body, the first pin member and the second pin member move to the engagement position when the operation member is moved to the first position whereas the first pin member and the second pin member move to the release position when the operation member is moved to the second position, the engagement position is a position where the first pin and the second pin are located outside a side surface of the housing in the width direction of the band, and the engagement position is closer to the coupling part than the release position is in the longitudinal direction of the band orthogonal to the width direction, and the release position is a position where the first pin and the second pin are located inside the side surface of the housing in the width direction, and the release position is closer to the engaging part than the engagement position is in the longitudinal direction.

With the band of the present disclosure, the first pin member and the second pin member can be moved to the engagement position by moving the operation member to the first position, and they can be moved to the release position by moving them to the second position. Thus, through the operation of the operation member by the user, a state of attaching the end member to the case by engaging each pin member with each engagement hole of the case and a state where the end member can be detached from the case by detaching each pin member from each engagement hole of the case can be switched, and the user of the watch can easily attach/detach the band.

In addition, when moving to the engagement position and the release position, each pin member moves, with respect to the housing, to the width direction of the band, and also to the longitudinal direction of the band, i.e., a direction approaching the engaging part of the housing and a direction approaching the coupling part of the housing. Since the engagement position of the first pin member and the second pin member are closer to the coupling part than the release position, the first pin member and the second pin member move in the direction away from the watch case with respect to the housing when moving from the release position to the engagement position. Therefore, relative to the first pin member and the second pin member that engage with the watch case, the housing moves in the direction approaching the watch case with respect to the first pin member and the second pin member when the first pin member and the second pin member move from the release position to the engagement position. Thus, the housing of the end member can prevent generation of backlash and/or gaps between the housing of the end member and the watch case, and can improve the external appearance even when a force is applied in the direction of pressing the engaging part against the watch case and there is a variation in components.

The band of the present disclosure preferably includes a biasing member configured to be held by the first pin member and the second pin member. The operation member is disposed between the first pin member and the second pin member, and includes a first guide surface and a second guide surface that are tilted with respect to the width direction of the band and the longitudinal direction of the band, the first pin member includes a first tilted surface that faces the first guide surface, the second pin member includes a second tilted surface that faces the second guide surface, and the biasing member brings the first tilted surface into contact with the first guide surface, and brings the second tilted surface into contact with the second guide surface.

With the band of the present disclosure, when the operation member is moved forward/backward in the longitudinal direction of the band, each pin member can be moved in the width direction of the band because the first tilted surface and the second tilted surface and the first guide surface and the second guide surface that are tilted with respect to the width direction and the longitudinal direction of the band are in contact with each other with the biasing member. Thus, the structure of moving each pin member in linkage with the operation of the operation member can be achieved in a simple configuration with a small number of components, and therefore a structure suitable for the band of the wristwatch can be achieved in a cost-effective manner.

In the band of the present disclosure, preferably, the first pin member and the second pin member include a guide hole extending in the width direction of the band and the longitudinal direction of the band, the housing includes a guide pin inserted to the guide hole, and the guide part includes the guide hole and the guide pin.

With the band of the present disclosure, the guide part that movably guides the first pin member and the second pin member between the engagement position and the release position is composed of the guide hole and the guide pin, which can be achieved with a simple structure in a space-saving manner, and thus a structure suitable for the band of the wristwatch can be achieved in a cost-effective manner.

In addition, since the movement path of each pin member can be set by the shape of the guide hole, the movement path with which the pin of each pin member can be easily inserted to the engagement hole of the watch case and the force of pressing the housing against the watch case can be increased after the pin is engaged with the engagement hole can be easily set only by the shape of the guide hole.

In the band of the present disclosure, preferably, the guide hole is formed in an arc shape such that displacement in the width direction of the band relative to displacement in the longitudinal direction of the band is larger outside in the width direction of the band.

With the band of the present disclosure, the guide hole has an arc shape, with which displacement in the width direction of the band is large relative to displacement in the longitudinal direction of the band as it goes toward the outside in the width direction of the band. Thus, the pin of each pin member can be easily inserted to the engagement hole of the watch case and the force of pressing the housing against the watch case can be increased after the pin is engaged with the engagement hole.

The band of the present disclosure preferably includes a holder plate fixed to the housing with a screw. The first pin member, the second pin member and the operation member are disposed between the housing and the holder plate.

With the band of the present disclosure, each pin member and the operation member can be reliably held with the housing and the holder plate. In addition, since the pin member and the operation member are disposed between the housing and the holder plate, exposure of the pin member and the operation member can be prevented, and the external appearance can be improved by achieving a simple external appearance.

In the band of the present disclosure, preferably, the operation member is configured to be movable to the first position and the second position in a state of being biased to the holder plate side by a second biasing member and pushed to the housing side against a biasing force of the second biasing member, the second biasing member being disposed between the housing and the operation member, and the operation member includes a movement restriction part configured to restrict movement to the second position by engaging with the holder plate when the operation member is located at the first position and biased by the second biasing member.

With the band of the present disclosure, the operation member can be moved to the first position and the second position only when the user pushes the operation member, and, in the state where the operation member is located at the first position, i.e., the state where each pin member is moved to the engagement position, the movement to the second position can be restricted with the movement restriction part of the operation member engaging with the holder plate with the biasing force of the second biasing member, i.e., the movement of the pin member from the engagement position to the release position can be restricted. Thus, in the state where the band is attached to the watch case, the attached state of the band can be reliably maintained unless the operation member is operated by the user, and the operation member can be detached by a simple operation of only pushing and moving the operation member to the second position.

In the band of the present disclosure, preferably, the operation member includes a long hole extending in the longitudinal direction of the band, and a holder plate part, and the operation member is fixed to the housing with a screw disposed at the long hole, and the first pin member and the second pin member are disposed between the housing and the holder plate part.

With the band of the present disclosure, since the operation member includes a holder plate part that holds each pin member between it and the housing, and thus the number of components can be reduced in comparison with the case where the operation member and the holder plate are composed of different components. In addition, since the size of the operation member integrated with the holder plate part can be large, the operability of the user can be improved.

The band of the present disclosure preferably includes a third biasing member disposed between the housing and the operation member and configured to bias the operation member in a direction for moving the operation member to the first position.

With the band of the present disclosure, when the user moves the operation member to the second position against the biasing force of the third biasing member, each pin member can be moved to the release position. In addition, when the user releases the operation of the operation member, the state where the operation member is moved to the first position with the biasing force of the third biasing member can be maintained, and each pin member can be also maintained at the engagement position. Thus, the user need only operate the operation member only when moving the pin member to the release position, and the attached state of the band can be reliably maintained unless the user operate the operation member.

A watch of the present disclosure includes the above-described band.

With the watch of the present disclosure, which includes the above-described band, the above-described effects can be achieved, backlash and/or gaps between the end portion of the band and the case can be reduced, and the external appearance can be improved.

A watch of the present disclosure includes a watch case including a first engagement hole and a second engagement hole facing each other, and a band including a band main body and an end member provided at an end portion of the band main body and attached to the watch case. The end member includes a first pin member including a first pin configured to be engageable with the first engagement hole, a second pin member including a second pin configured to be engageable with the second engagement hole and disposed with a distance from the first pin member in a width direction of the band, an operation member configured to be movable to a first position and a second position, and a housing configured to hold the first pin member, the second pin member and the operation member, and the first pin member and the second pin member are configured to be movable to an engagement position where the first pin member and the second pin member engage with the first engagement hole and the second engagement hole when the operation member is moved to the first position, and movable to a release position where the first pin member and the second pin member do not engage with the first engagement hole and the second engagement hole when the operation member is moved to the second position.

With the watch of the present disclosure, the first pin member and the second pin member can be moved to the engagement position by moving the operation member to the first position, and they can be moved to the release position by moving them to the second position. Thus, through the operation of the operation member by the user, a state of attaching the end member to the case by engaging each pin member with each engagement hole of the case and a state where the end member can be detached from the case by detaching each pin member from each engagement hole of the case can be switched, and the user of the watch can easily attach/detach the band.

In addition, when moving to the engagement position and the release position, each pin member moves to the width direction of the band, and also to the longitudinal direction of the band, i.e., a direction away from the watch case and a direction approaching the watch case. Since the engagement position of the first pin member and the second pin member are located father from the watch case than the release position, the first pin member and the second pin member move in the direction away from the watch case with respect to the housing when moving from the release position to the engagement position. Therefore, relative to the first pin member and the second pin member that engage with the watch case, the housing moves in the direction approaching the watch case with respect to the first pin member and the second pin member when the first pin member and the second pin member move from the release position to the engagement position. Thus, the housing of the end member can prevent generation of backlash and/or gaps between the housing of the end member and the watch case, and can improve the external appearance even when a force is applied in the direction of pressing against the watch case and there is a variation in components.

What is claimed is:

1. A band configured to be attached to a watch case including a first engagement hole and a second engagement hole facing each other, the band comprising:

a band main body; and an end member provided at an end portion of the band main body, wherein the end member includes:

a first pin member including a first pin configured to be engaged with the first engagement hole;

a second pin member including a second pin configured to be engaged with the second engagement hole, the second pin member being disposed with a distance from the first pin member in a width direction of the band;

an operation member configured to move between a first position and a second position;

a housing having a concave region, the housing holding the first pin member, the second pin member, and the operation member in the concave region; and a guide part configured to guide the first pin member and the second pin member to move between an engagement position and a release position with respect to the housing, the housing includes:

an engaging part configured to be engaged with the watch case; and a coupling part separated from the engaging part in a longitudinal direction of the band and configured to be coupled with the band main body, the first pin member and the second pin member move to the engagement position when the operation member is moved to the first position whereas the first pin member and the second pin member move to the release position when the operation member is moved to the second position, in the engagement position:

the first pin and the second pin are respectively located outside side surfaces of the housing in the width direction of the band;

the operation member is located closer to the engaging part of the housing than the coupling part of the housing; and the operation member is spaced apart from a bottom of the concave region of the housing by a first distance;

in the release position;

the first pin and the second pin are respectively located inside the side surfaces of the housing in the width direction;

the operation member is located closer to the coupling part of the housing than the engaging part of the housing; and the operation member is spaced apart from a bottom of the concave region of the housing by a second distance, and the first distance is larger than the second distance.

2. The band according to claim 1, further comprising first and second biasing members configured to be held by the first pin member and the second pin member, respectively, wherein the operation member is disposed between the first pin member and the second pin member, and includes a first guide surface and a second guide surface that are tilted with respect to the width direction of the band and the longitudinal direction of the band;

the first pin member includes a first tilted surface that faces the first guide surface;

the second pin member includes a second tilted surface that faces the second guide surface; and the first biasing member brings the first tilted surface into contact with the first guide surface, and the second biasing member brings the second tilted surface into contact with the second guide surface.

3. The band according to claim 1, wherein the first pin member and the second pin member include first and second guide holes, respectively, extending in the width direction of the band and the longitudinal direction of the band;

the housing includes first and second guide pins inserted to the first and second guide holes, respectively; and the guide part includes the first and second guide holes and the first and second guided pins.

4. The band according to claim 3, wherein each of the first and second guide holes is formed in an arc shape, and a length of each of the first and second guide holes in the width direction of the band is larger than a length of each of the first and second guide holes in the longitudinal direction of the band.

5. The band according to claim 1, further comprising a holder plate fixed to the housing with a screw, wherein the first pin member, the second pin member, and the operation member are disposed between the housing and the holder plate.

6. The band according to claim 5, further comprising another biasing member disposed between the housing and the operation member, wherein the operation member is biased to a side of the holder plate by the another biasing member, the operation member is configured to be movable between the first position and the second position in a state in which the operation member is pushed toward a side of the housing against a biasing force of the another biasing member; and the operation member includes a movement restriction part configured to restrict movement to the second position by engaging with the holder plate when the operation member is located at the first position and biased by the another biasing member.

7. The band according to claim 1, wherein the operation member includes a long hole extending in the longitudinal direction of the band, and a holder plate part; and the operation member is fixed to the housing with a screw disposed at the long hole; and the first pin member and the second pin member are disposed between the housing and the holder plate part.

8. The band according to claim 7, comprising a third biasing member disposed between the housing and the operation member and configured to bias the operation member in a direction for moving the operation member to the first position.

9. A watch comprising the band according to claim 1.

10. A watch comprising:

a watch case including a first engagement hole and a second engagement hole facing each other; and a band including;

a band main body; and an end member provided at an end portion of the band main body, the band being configured to be attached to the watch case via the end member, wherein the end member includes:

a first pin member including a first pin configured to be engaged with the first engagement hole;

a second pin member including a second pin configured to be engaged with the second engagement hole, the second pin member being disposed with a distance from the first pin member in a width direction of the band;

an operation member configured to move between a first position and a second position;

a housing having a concave region, the housing holding the first pin member, the second pin member, and the operation member in the concave region; and a guide part configured to guide the first pin member and the second pin member to move between an engagement position and a release position with respect to the housing, the housing includes:

an engaging part configured to be engaged with the watch case; and a coupling part separated from the engaging part in a longitudinal direction of the band and configured to be coupled with the band main body, the first pin member and the second pin member move to the engagement position when the operation member is moved to the first position whereas the first pin member and the second pin member move to the release position when the operation member is moved to the second position, in the engagement position:

the first pin and the second pin are respectively located outside side surfaces of the housing in the width direction of the band;

the operation member is located closer to the engaging part of the housing than the coupling part of the housing; and the operation member is spaced apart from a bottom of the concave region of the housing by a first distance;

in the release position:

the first pin and the second pin are respectively located inside the side surfaces of the housing in the width direction;

the operation member is located closer to the coupling part of the housing than the engaging part of the housing; and the operation member is spaced apart from a bottom of the concave region of the housing by a second distance, and the first distance is larger than the second distance.

* * * * *